United States Patent [19]

Pater et al.

[11] 4,010,848

[45] Mar. 8, 1977

[54] FRONT RESTRAINT DEVICE FOR SHIPPING BINS

[75] Inventors: Walter E. Pater, New Kensington; James R. Rowley, Freeport, both of Pa.

[73] Assignee: PPG Industries, Inc., Pittsburgh, Pa.

[22] Filed: Dec. 11, 1975

[21] Appl. No.: 639,727

Related U.S. Application Data

[62] Division of Ser. No. 488,851, July 15, 1974, Pat. No. 3,963,122.

[52] U.S. Cl. ..... 206/448; 105/367; 206/454; 267/136

[51] Int. Cl.[2] ..... B65D 85/48

[58] Field of Search ..... 206/448–454, 206/552; 211/49 R, 51; 248/21, 22, 26, 119 R; 214/10.5 R; 267/136, 139; 105/367, 376, 496

[56] References Cited

UNITED STATES PATENTS

| | | | |
|---|---|---|---|
| 1,833,764 | 11/1931 | Tremblay et al. | 105/496 |
| 2,331,416 | 10/1943 | Muller, Sr. | 105/367 |
| 2,940,402 | 6/1960 | Hansen et al. | 105/367 |
| 3,147,715 | 9/1964 | Myers | 105/367 |
| 3,427,995 | 2/1969 | Stafford, Jr. | 105/496 |
| 3,754,516 | 8/1973 | van Gompel | 105/496 |
| 3,809,234 | 5/1974 | Kurick | 206/448 |
| 3,964,608 | 6/1976 | Rowley | 206/454 X |

FOREIGN PATENTS OR APPLICATIONS

| | | | |
|---|---|---|---|
| 2,241,358 | 3/1973 | Germany | 267/139 |

*Primary Examiner*—William Price
*Assistant Examiner*—Stephen Marcus
*Attorney, Agent, or Firm*—Donald Carl Lepiane

[57] ABSTRACT

This invention relates to a front restraint device for article shipping bins. The articles, e.g., automotive backlites are positioned on an edge and tilted to rest on an adjustable back support for packing stability. The articles are secured in the bin by a pneumatic front restraint device or a mechanical front restraint device incorporating features of the invention and mounted at the ingress end of the bin. The pneumatic front restraint device includes an inflatable member which when inflated moves a rigid pad into engagement with the articles. The mechanical front restraint device includes a rigid pad which is moved into engagement with the articles and biased toward the articles. The front restraint devices act on the articles to (1) secure the articles in the bin as a unitized pack; (2) limit oscillatory and lateral motions of the articles; and (3) dampen oscillatory and lateral forces acting on the articles during transit.

13 Claims, 10 Drawing Figures

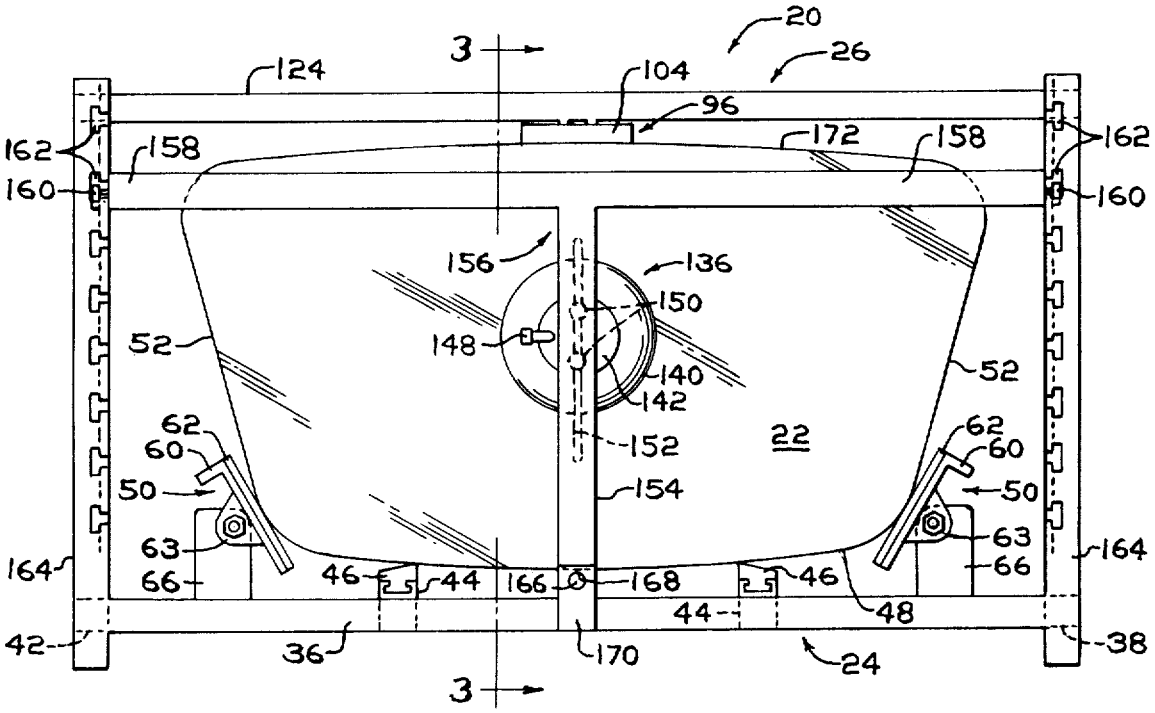
FIG. 2
FIG. 3
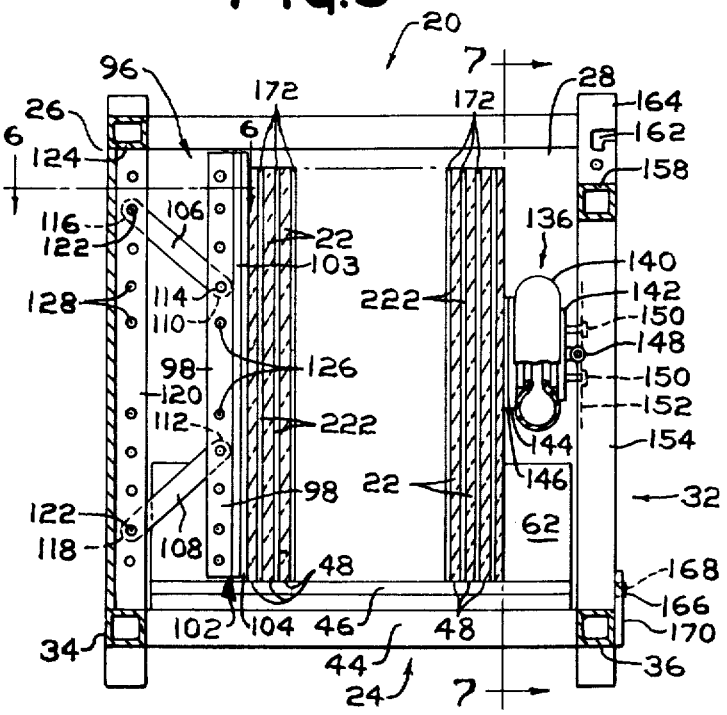
FIG. 7
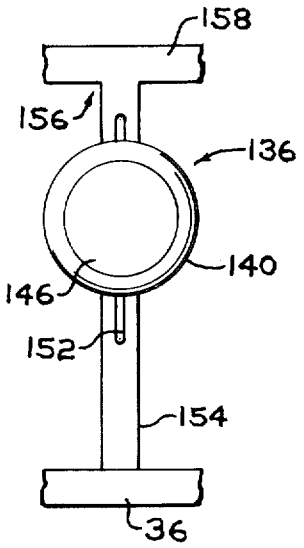

FIG. 6
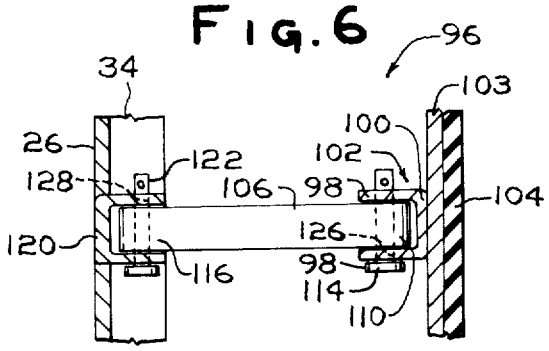
FIG. 4
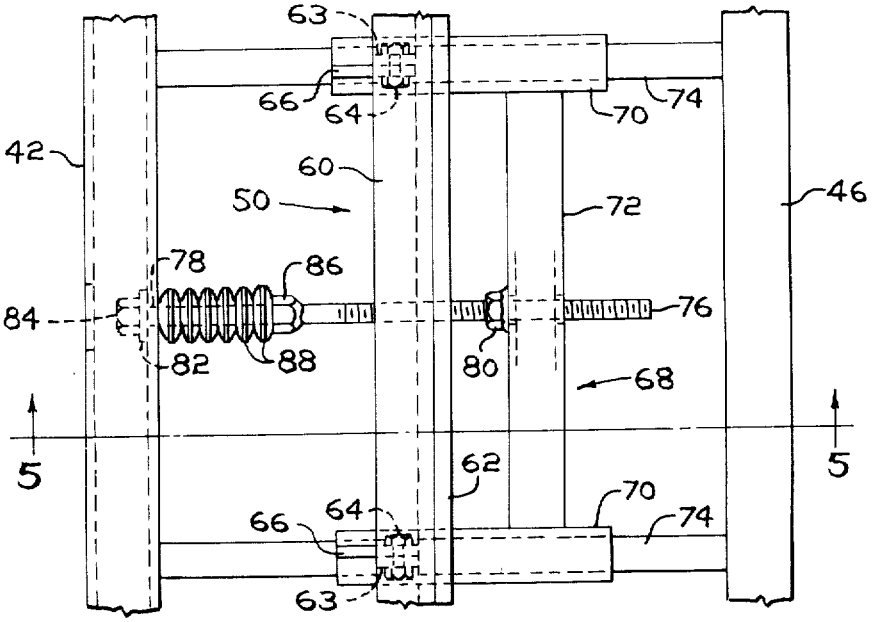
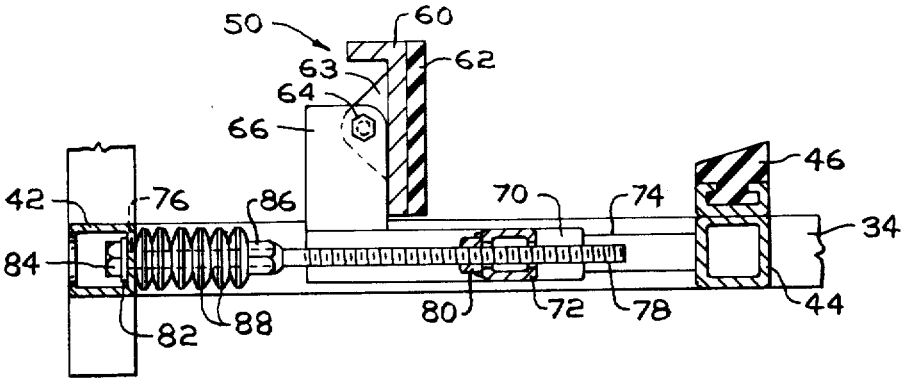
FIG. 5

FRONT RESTRAINT DEVICE FOR SHIPPING BINS

This is a division, of application Ser. No. 488,851, filed July 15, 1974, now U.S. Pat. No. 3,963,122.

CROSS REFERENCE TO RELATED APPLICATIONS

The end restraint system disclosed in U.S. Pat. application Ser. No. 488,346, now U.S. Pat. No. 3,961,709, filed even date in the name of James R. Rowley and entitled "End Restraints For Shipping Bins" may be used with the front restraint devices of the invention, and the adjustable back support disclosed in U.S. Pat. application Ser. No. 488,347, now U.S. Pat. No. 3,964,608 filed even date in the name of James R. Rowley and entitled "Adjustable Back Support For Shipping Bins" may be used with the front restraint devices of the invention. The teachings of the above-mentioned applications are hereby incorporated by reference.

BACKGROUND OF THE INVENTION

1. FIELD OF THE INVENTION

This invention relates to front restraint devices for securing articles, e.g., glass sheets, automotive backlites, automotive windshileds or automotive sidelights, in an article shipping bin.

2. DISCUSSION OF THE TECHNICAL PROBLEMS

Articles, e.g., glass sheets, automotive backlites, automotive windshields, or automotive sidelights, are normally shipped to automotive manufacturers in bins or racks.

During shipment, e.g., by rail car or truck, the articles in the bins are subjected to transporation forces. For example, the articles are subjected to (1) longitudinal forces which act to move the articles toward and away from the sidewalls of the bin, i.e., along a longitudinal reciprocating path; (2) oscillatory forces which tend to move the articles about a pivot point toward and away from the back wall of the bin, i.e., along an oscillatory reciprocating path; and (3) lateral forces which tend to move the articles toward and away from the back wall of the bin, i.e., along a lateral reciprocating path.

These forces which act on the articles are caused by the motion of the rail car or truck as it moves along the rails or road respectively. As can be appreciated by those skilled in the art, these longitudinal, oscillatory and lateral forces can damage the articles during transit making them unusable.

In general, to prevent damage to the articles, e.g., automotive backlites, during shipping, the backlites are normally loaded in a bin in a vertical position with an edge of the backlites resting on a resilient pad and tilted toward the back wall of the bin for packing stability. The tilting of the backlites facilitates loading of the backlites into the bin and also tends to reduce the oscillatory motion of the backlites during shipment. More particularly, because the articles are on one edge tilted toward the back wall, a greater force has to be applied to oscillate the backlites about the bottom edge thereby canceling out small swaying motions of the rail car or truck.

In the prior art, bins used for transporting automotive backlites are provided with a wedged shaped member positioned in the back of the bin to provide a tilt to the backlites. This is undesirable for several reasons; namely, (1) when the bin is unloaded, the wedged shaped member has to be disposed of creating a solid waste problem; and (2) for partial loads and different curvature of backlites, it is required to have on hand different shaped wedge members thereby requiring different members to be made and stored.

To minimize and/or cancel longitudinal forces of the backlites during transit, dunnage, e.g., pieces of wood and corrigated cardboard are secured between the sides of the backlites and the sidewalls of the bin. This is undesirable because (1) after the bin is unloaded, the dunnage has to be disposed of creating a solid waste problem; and (2) the dunnage becomes compressed during transit by the longitudinal forces moving the sides of the backlites against the dunnage thereby increasing the longitudinal reciprocating path. Especially in the instance where the articles are untempered glass increasing the longitudinal reciprocating path moves the articles along an increased longitudinal reciprocating path thereby increasing the probability of damaging the sides of the articles.

The prior art practice to prevent or minimize oscillatory and lateral forces acting on the backlites during transit is to secure the backlites in the bin against the back wall with webbing or steel bands. During transit, the oscillatory and lateral forces of the backlites stretch the bands and webbing which can cause the backlites to fall out of the bin. Further, when the webbing and steel bands stretch, the oscillatory and lateral reciprocating paths increase. In the instance where the articles are untempered glass, this causes individual articles to have individual oscillatory paths and frequencies instead of the articles acting as a unitized pack. When this occurs, the articles slam against each which can damage the articles. When the oscillatory and lateral paths increase and the articles act as a unitized pack, the outermost articles are subjected to increased forces and are damaged. Further, applying and removing the webbing or steel bands is time consuming and still further, disposing of the steel bands creates a solid waste disposal problem.

There are available systems for eliminating the webbing and steel bands but these systems have limitations. For example, disclosed in U.S. Pat. application Ser. No. 371,912 filed June 20, 1973, in the names of James R. Rowley and Walter E. Pater and entitled "Method of and Device for Restraining Movement of Articles During Transit" there is disclosed a front restraint system that eliminates webbing and steel bands. In general, a plurality of upper pads and a plurality of lower pads are provided on a generally H-shaped member. After the articles, e.g., automotive windshields are loaded in a rack, the pads are moved into locking engaging with the articles. Oscillatory forces acting on the upper pads are dampened by the pivoting action of the upper and lower pads. Although the device of the above-identified application is ideally suitable for shipping automotive windshields, it is expensive to construct and use. It is expensive to use because each of the four pads has to be moved into engagement with the articles and thereafter locked in position.

It would be advantageous, therefore, if a bin for shipping articles were available that did not have the drawbacks or limitations of the prior art. More particularly, it would be advantageous to provide a bin with (1) a front restraint system that is economical to construct and use; and does not have the drawbacks of steel bonds and webbing; (2) an end restraint system; and (3) an adjustable back support that eliminates the solid waste problems.

SUMMARY OF THE INVENTION

This invention relates to a restraining device for dampening oscillatory and lateral forces acting on articles, e.g., automotive backlites supported on a first edge and tilted toward a support member. The oscillatory forces move the articles about the first edge toward and away from the support member along a first article movement path, i.e., along an oscillatory reciprocating path. The lateral forces move the articles away from the support member along a second article movement path, i.e., along a lateral reciprocating path.

The restraining device includes biasing facilities engaging a discrete portion of the articles within the sides thereof for urging the articles together against the support member such that the articles respond to the oscillatory and lateral forces as a unitized pack and for absorbing oscillatory and lateral forces of the articles during shipment to dampen the oscillatory and lateral forces acting on the article. Facilities are provided for securely mounting the biasing facilities in the first and second article movement paths.

The restraining device in one embodiment is defined as a pneumatic restraining device and includes an inflatable member and a valve for inflating the member to move the member into engagement with the articles to urge the articles together against the support member and to dampen oscillatory and lateral forces acting on the articles.

The restraining device in another embodiment is defined as a mechanical restraint device and includes a rigid member having opposed major surfaces. A spring biased shaft has one end mounted in a housing and the other end pivotally mounted to a major surface of the rigid member. The shaft is biased as by a spring to urge the rigid member against the articles to urge the articles together against the support member and to dampen oscillatory and lateral forces acting on the articles.

The invention further contemplates the use of the restraining device of the invention with a bin of the type used to ship articles. The bin may include an adjustable back support member mounted on a base to provide the backlites with packing stability and end restraint facilities movably mounted on the base for minimizing longitudinal motion of the backlites and for dampening longitudinal forces acting on the backlites during shipment.

The invention further contemplates a method of containing articles, e.g., automotive backlites, during shipment including the steps of loading the articles in the bin on a first edge and tilted to rest on a rigid member. An end of a first and second strut is pivotally mounted to the rigid member. The opposite end of the struts is pivotally mounted to the backwall. A plate mounted on a carriage is moved into engagement with the sides of the articles. Forces applied to the carriage are dampened as the carriage is maintained in contact with the sides of the articles. Thereafter the articles are urged together toward the back wall such that the articles respond to oscillating and lateral forces as a unitized pack. A discrete portion of the outermost article within the perimeter thereof is engaged with biasing means to dampen oscillatory and lateral forces acting on the articles during shipment.

BRIEF DESCRIPTION OF THE DRAWING

FIG. 2 is a front view of the bin of FIG. 1 loaded with automotive backlites;

FIG. 3 is a view taken along lines 3—3 of FIG. 2 having portions removed for purposes of clarity;

FIG. 4 is a fragmented top view of the left side of the bin of FIG. 1;

FIG. 5 is a view taken along lines 5—5 of FIG. 4;

FIG. 6 is a view taken along lines 6—6 of FIG. 3 and having portions removed for purposes of clarity showing an adjustable back support member;

FIG. 7 is a fragmented view taken along lines 7—7 of FIG. 3 showing a front view of the pneumatic front restraint device incorporating features of the invention;

DESCRIPTION OF THE INVENTION

Figure 1:
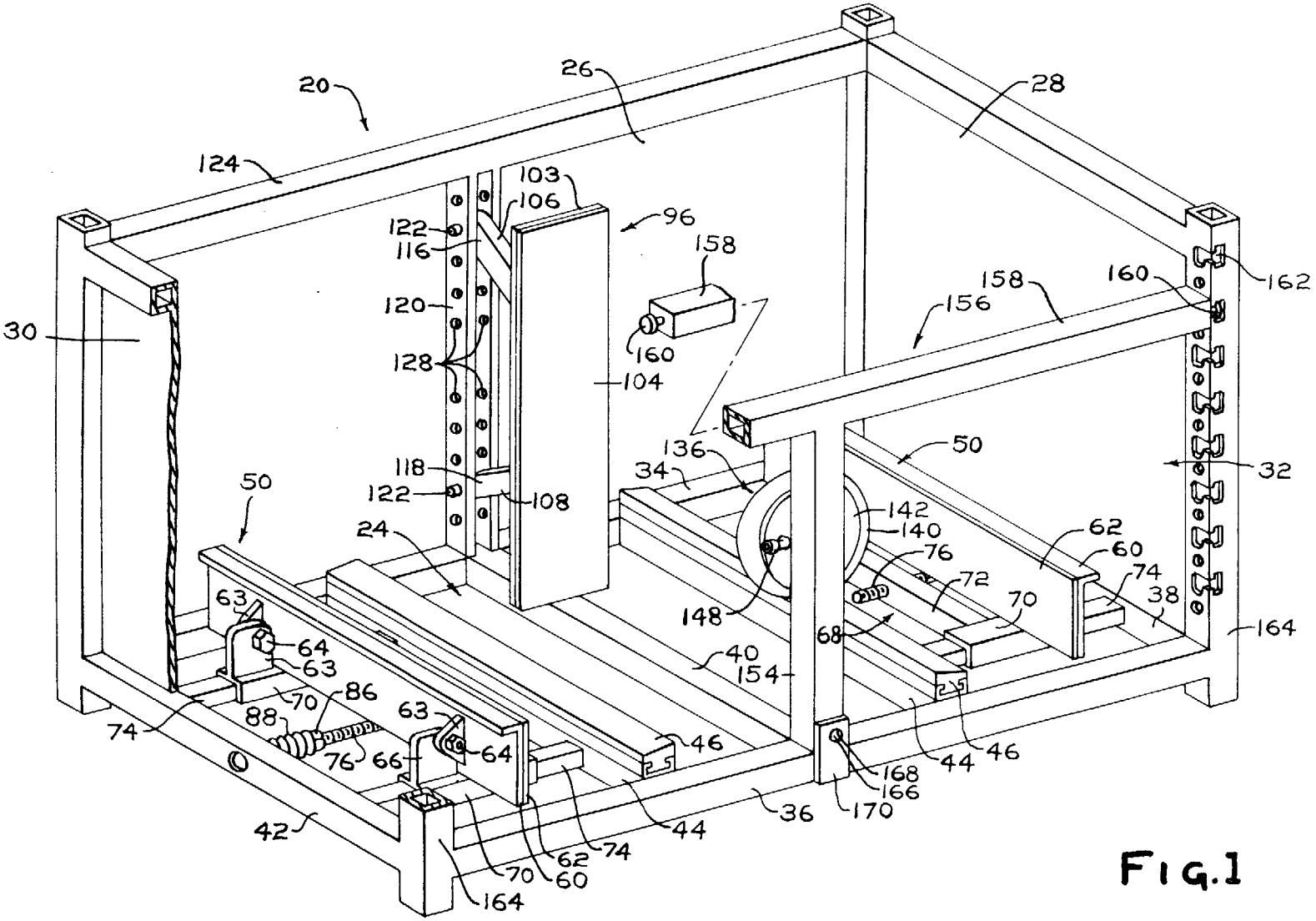
FIG. 1 is an isometric view of a bin having portions removed for purposes of clarity and having a pneumatic front restraint device incorporating features of the invention mounted at the ingress end of the bin.

In general, the invention relates to front restraint devices that may be used with article shipping bins. Referring to FIG. 1, there is shown a bin 20 used for transporting articles 22 (shown in FIGS. 2 and 3) for example, glass plates, automotive backlites, automotive sidelights, or automotive windshields incorporating features of the invention. In general, the bin 20 includes a base 24, a back wall 26, a right and left sidewall 28 and 30, respectively, as viewed in FIG. 1 secured together to define the bin 20 having an ingress end 32.

Certain terms which will be used herein are now defined for purposes of clarity. "Longitudinal motion of the articles" as the term is used herein, is the motion of the articles along a longitudinal reciprocating path. "Longitudinal reciprocating path" as the term is used herein is the motion of the articles toward and away from the sidewalls of the bin. "Longitudinal forces" as the term is used herein are the forces acting on the articles which impart longitudinal forces to the articles to move them along the longitudinal reciprocating path. "Oscillatory motion of the articles" as the term is used herein is the motion of the articles along an oscillatory reciprocating path. "Oscillatory reciprocating path" as the term is used herein is a path subtended by the articles as they pivot about a bottom edge toward and away from the back wall of the bin. "Oscillatory forces" as the term is used herein are the forces acting on the articles which impart oscillatory forces to the articles to move them along the oscillatory reciprocating path. "Lateral motion of the articles" as the term is used herein is the motion of the articles along a lateral reciprocating path. "Lateral reciprocating path" as the term is used herein is the motion of the articles toward and away from the back wall of the bin. "Lateral forces" as the term is used herein are the forces acting on the articles which impart lateral forces to the articles to move them along the lateral reciprocating path.

The longitudinal, lateral and oscillatory forces are generated by the acceleration, deceleration or swaying motion of the truck or rail car.

The base 24, in general, is defined by a pair of spaced rigid longitudinal members 34 and 36 interconnected to a right lateral member 38, a center lateral member 40, and a left lateral member 42. A pair of stationary runners 44 each having a resilient pad 46 for supporting the articles on an edge 48 (shown in FIGS. 2 and 3) is secured between the longitudinal members 34 and 36. An end restraint 50 is provided adjacent each one of the sidewalls 28 and 30 for engagement with the sides 52 of the articles (shown in FIG. 2) to prevent or minimize longitudinal motion and to dampen longitudinal forces of the articles during transit.

As will be appreciated, the invention is not limited to the type of end restraints employed to prevent longitudinal motion and dampen longitudinal forces of the articles during transit.

Disclosed in U.S. Pat. appliction Ser. No. 488,346, now U.S. Pat. No. 3,961,709, filed even date in the name of James R. Rowley and entitled "End Restraints For Shipping Bins" there is disclosed an end restraint that may be used in the practice of the invention.

With continued reference to FIG. 1, the end restraint 50 on the right and left side of the bin as viewed in FIG. 1 are identical in construction; therefore, the end restraint of the left side of the bin 20 as viewed in FIG. 1 will be discussed for purposes of simplicity with the understanding that the discussion is also applicable to the end restraint on the right side of the bin unless indicated otherwise.

With reference to FIGS. 4 and 5, the end restraint 50 includes a rigid inverted L-shaped plate 60 having a resilient pad 62 on one surface. A pair of spaced plates 63 are provided on the opposed surface to pivotally mount the plate 60 at 64 to each one of a pair of uprights 66 of a movable carriage 68. The plate 60 is pivotally mounted to seat against the sides 52 of the articles. The resilient pad 62 prevents marring of the sides 52 of the articles (see FIG. 2).

The carriage 68 further includes a pair of sleeves 70 securely connected to the uprights 66 and interconnected by a rigid member 72 for simultaneously moving the sleeves 70 and end restraint toward and away from the sides 52 of the articles on guide rails 74.

With reference to FIG. 1, the guide rails 74 on the left side of the bin are securely mounted by any conventional manner between the lateral member 42 and adjacent stationary runner 44. The guide rails 74 on the right side of the bin as viewed in FIG. 1 are securely mounted in any conventional manner between the lateral member 38 and the adjacent stationary runner 44.

Referring back to FIGS. 4 and 5, a threaded shaft 76 having one end 78 freely mounted in the lateral member 42, passes through nut 80 securely mounted on the rigid member 72 and through the rigid member 72. The end 78 of the shaft has a washer 82 and a nut 84 securely mounted thereto to (1) prevent movement of a shaft 76 toward adjacent runner 44; and (2) rotate the shaft to move the carriage 68 and end restraint 50 toward and away from the side of the articles, respectively. A nut 86 is securely mounted on the shaft 76 between the rigid member 72 of the carriage 68 and the lateral member 42. A plurality of disc springs 88 are provided on the shaft 76 between the nut 86 and cross member 42 to provide facilities to (1) bias the end restraint toward the sides 52 of the articles (see FIG. 2); (2) prevent longitudinal motion of the articles during transit and (3) dampen longitudinal forces of the articles during transit.

In practice, after the articles are loaded in the bin 20, the shaft 76 is rotated in a first direction to move the end restraint 50 into engagement with the side 52 of the articles. The spring 88 maintains the carriage 68 and end restraints 50 against the sides 52 of the articles to prevent longitudinal motion of the articles along the longitudinal reciprocating path. When the longitudinal forces exceed the biasing action of the springs 88, e.g., the springs 88 on the left side of the bin as viewed in FIG. 1, the articles move toward the left side of the bin. Movement of the articles toward the left side comprises the spring between the nut 86 on the shaft 76 and the lateral member 42. The spring 88 compresses until the biasing action of the spring exceeds the longitudinal forces acting on the articles. The spring thereupon acts to move the carriage 68 and end restraint 50 away from the left sidewall 30 moving the articles toward the right sidewall 28 against the right end restraint 50. The right end restraint 50 responds to the movement of the articles in a similar manner as the left end restraint when the articles moved toward the left sidewall. In this manner, the longitudinal forces acting on the articles are dampened as the articles move along the longitudinal reciprocating path.

With reference to FIG. 3, the articles 22 are tilted toward the back wall 26 on a back support 96 to provide packing stability and to minimize swaying, e.g., small oscillatory forces, imparted to the articles during transit.

The tilting of the articles may be accomplished in any conventional manner. Disclosed in U.S. Pat. application Ser. No. 488,347, now U.S. Pat. No. 3,964,608 filed even date in the name of James R. Rowley and entitled "Adjustable Back Support For Shipping Bins" there is disclosed the adjustable back support member 96 that may be used with the present invention.

With reference to FIGS. 1, 3 and 6, there is shown the back restraint member 96 which includes a pair of rigid plates 98 interconnected by a third rigid plate 100 to form a generally U-shaped member 102 (shown better in FIG. 6). A rigid plate 102 is securely joined to the plate 100 of the U-shaped member 102. A resilient pad 104 is advantageously secured to outer surface of the plate 103 to prevent marring of the surface of the article in contact therewith and to dampen oscillatory and lateral forces of the articles as the articles move toward the back wall of the bin. A top strut 106 and a bottom strut 108 are each pivotally mounted at one end 110 and 112, respectively, to the plates 98 by way of pins 114. Each strut 106 and 108 is mounted at their other end 116 and 118, respectively, to a U-shaped channel member 120 by way of pins 122.

The U-shaped channel member 120 is securely mounted between the longitudinal member 34 and longitudinal member 124 of the back wall 26. To provide for various adjustments of the back support member 96, the plates 98 and U-shaped channel member 120 are advantageously provided with a plurality of holes 126 and 128, respectively. To prevent the back support member 96 from collapsing, it is recommended that (1) the U-shaped channel member 120; (2) U-shaped member 102; and (3) the struts 106 and 108 form a frustrum of a triangle as illustrated in FIG. 3 with the bottom end of the rigid plate 103 resting on the center lateral member 40 as shown in FIG. 1. More particularly, the distance between ends 110 and 112 of the struts 106 and 108, respectively, is less than the distance between ends 116 and 118 of the struts 106 and 108, respectively.

By selectively positioning the struts 106 and 108, the back support member 96 may be (1) tilted at any angle to support the articles; and (2) spaced at any lateral distance from the back wall to accommodate partial loads and accommodate various patterns. Preferably, the angle of tilt is approximately 5° from a line normal to the base 24 of the bin 20.

The discussion will now be directed to the front restraining device of the invention which (1) secures the articles in the bin as a unitized pack; (2) limits oscillatory and lateral motions of the articles during transit; and (3) dampens oscillatory and lateral forces of the articles as the articles move along the oscillatory and lateral paths during transit.

Figure 8:
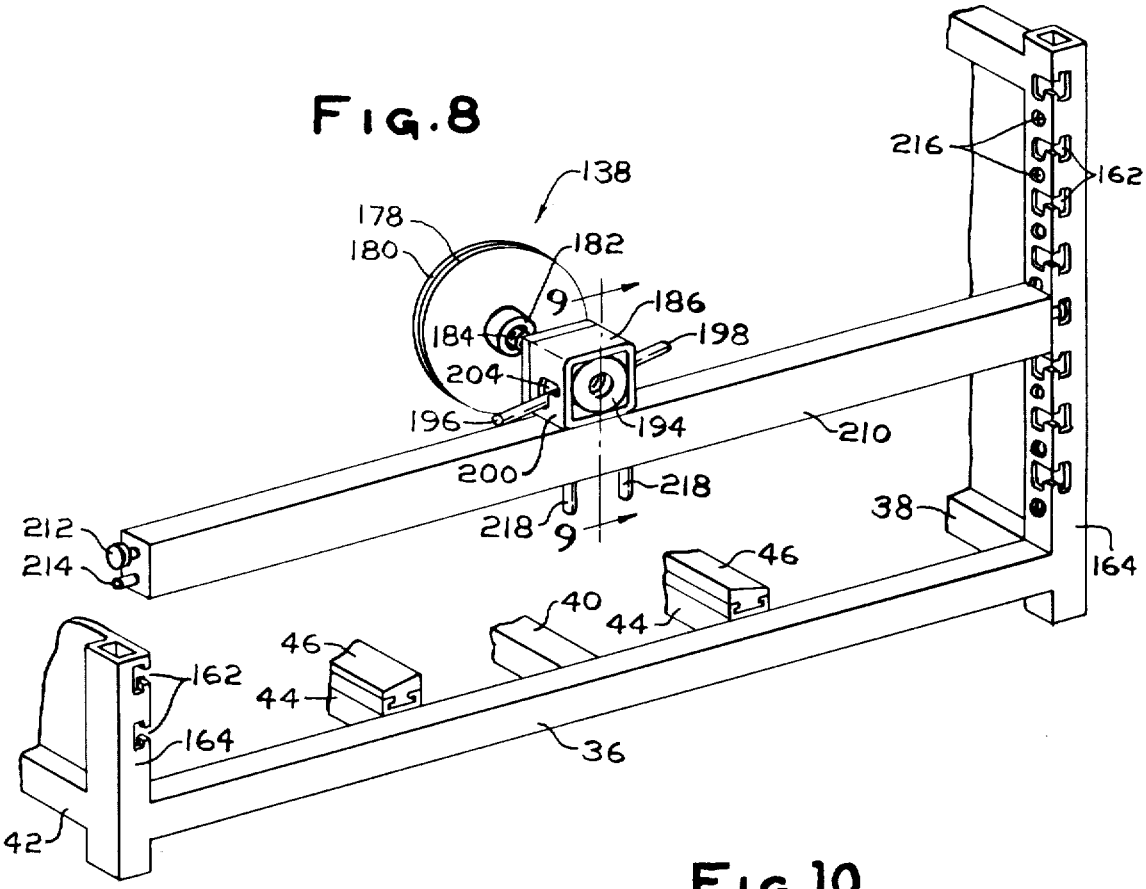
FIG. 8 is a fragmented isometric view of the bin of FIG. 1 having a mechanical front restraint device incorporating features of the invention mounted at the ingress end of the bin.
Figure 9:
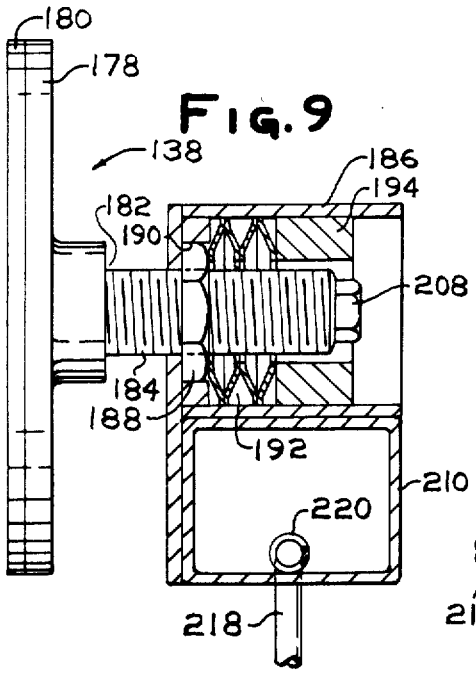
FIG. 9 is a view taken along lines 9—9 of FIG. 8.
Figure 10:
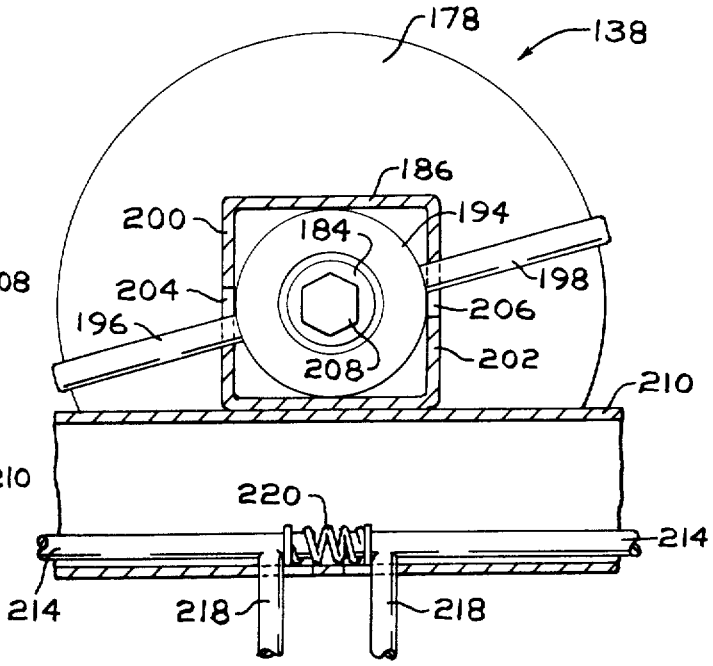
FIG. 10 is a back view of the mechanical restraint device having portions removed for purposes of clarity.

With reference to FIGS. 1, 2, 3 and 7, there is shown a pneumatic front restraint device 136 incorporating features of the invention and in FIGS. 8, 9 and 10, there is shown a mechanical front restraint device 138 incorporating features of the invention.

In general, and with reference to FIGS. 1, 2, 3 and 7, the pneumatic restraint device 136 includes an inflatable member 140 having a rigid pad 142 on one surface and a rigid pad 144 advantageously mounted on opposed surfaces of the inflatable member. The rigid pad 144 which is moved into engagement with the outermost article when the member 140 is inflated, is provided with a resilient pad 146 to prevent marring of the article surface (see FIGS. 3 and 7). The inflatable member 140 is inflated and deflated by way of a valve 148 which is advantageously mounted on the rigid pad 142. An inflatable member having the above features that may be used in the practice of the invention are sold by Firestone Co. under the trademark Airmounts .

The pneumatic restraint device 136 may be mounted at the ingress end 32 of the bin 20 in any conventional manner. For example, and with reference to FIGS. 2, 3 and 7, a pair of headed studs 150 may be provided on the rigid pad 142 of the restraining device 136. The studs 150 are advantageously slideably mounted in groove 152 provided on leg 154 of a T-shaped member 156 (see FIGS. 1 and 7). Referring now to FIG. 2, the T-shaped member 156 may be secured at the ingress end 32 of the bin 20 in any conventional manner. For example, ends of outward arms 158 of the T-shaped member 156 may each be provided with a headed stud 160 which is seated in one of a plurality of grooves 162 provided on posts or standards 164 at the ingress end of the bin 20. The leg 154 may be provided with a stud 166 which is positioned in hole 168 of a plate 170 secured to the longitudinal member 36 at the ingress end 32 of the bin 20 (see FIGS. 1 and 3).

The rigid pad 144 and resilient pad 146 have a surface area such that the force applied by the inflatable member is distributed over a relatively large area of the articles to prevent concentration of forces which could damage the articles. In general, it is recommended that the ratio of the surface area of the articles to be engaged by the rigid pad 144 and resilient pad 146 and the area of the pads 144 and 146 be between about 30–40. For example, for articles each having a surface area of 12 square feet (1.10 square meters) the pads 144 and 146 should each have a surface area of about 0.4 square feet (0.0037 square meters).

The force of the inflatable member 140 should be sufficient to urge the articles together toward the back wall against the back restraint member 96 so that the articles respond to transportation forces, e.g., oscillatory forces and lateral forces as a unitized pack. As can be appreciated, as the weight of the weight of the pack of articles increases, the force of the inflatable member should be increased. It has been found that inflating the member 140 to pressures of between 20 to 50 pounds per square inch (psi) (1.4 to 3.5 kilograms per square centimeter) is sufficient for packs of articles having a weight of between 1 to 2 English tons (1.016 to 2.032 metric tons). If the inflatable member 140 is inflated to about 75 psi (5.2 kilograms per square centimeter) for a 2 English ton (2.032 metric ton) pack, the glass has been found to fracture before the inflatable member can respond to dampen the transportation forces.

As can be appreciated, most of the oscillatory forces act on top edge 172 of the articles with the bottom edge 48 (see FIG. 3) held in place by the resilient pads 46. It is therefore recommended that the pneumatic restraint device 136 engage the articles a distance from the top edge 172 equal to about ⅓ the distance between the top edge and bottom edge of the articles.

As can be appreciated, the invention is not limited to the distance the pneumatic restraint device travels before engaging the outermost article. However, it has been found that a 3 inch (7.6 centimeters) deflection, e.g., movement of the inflatable member toward the articles before engagement of the outermost article gives satisfactory results.

With reference to FIGS. 8, 9 and 10, the discussion will now be directed to the mechanical front restraint device 138 incorporating features of the invention.

The mechanical restraint device 138 includes a rigid member 178 having a resilient pad 180 on a surface to prevent marring of the article surface in contact therewith. On the opposed side of the rigid member 178, there is pivotally mounted at 182 one end of a threaded shaft 184.

With reference to FIG. 9, the threaded shaft 184 is captured in a housing 186 by way of a nut 188 which has one degree of movement, more particularly, the nut 188 has reciprocal movement toward and away from the articles. This may be accomplished by providing a nest 190 in which the nut 188 is seated to prevent rotation of the nut when the shaft 184 is rotated while permitting the nut 188 and shaft 184 to move toward and away from the articles against a spring 192. The spring 192 may be a helical spring or a plurality of disc springs such as the type sold by E. C. Styberg Engineering Co., Inc.

The spring 192 is mounted in the housing 186 and put into compression by a washer 194 having a pair of fingers 196 and 198 secured to the periphery of the washer 194 (see FIG. 10). The fingers 196 and 198 extend out of sides 200 and 202, respectively, of the housing 186 by way of slots 204 and 206, respectively. Slots 204 and 206 are arranged to permit movement of the fingers 196 and 198, respectively, toward the articles to move the washer against the biasing action of the spring 192 and to lock the spring in place under compression. This may be accomplished by providing an inverted L-shaped slot, e.g., slot 204, on one side 200, and an upright L-shaped slot, e.g., slot 206 on side 202.

In practice, the articles are loaded in the bin and the fingers 196 and 198 are urged along the short leg of the L-shaped slot 204 and 206, respectively, to move the washer 194 against the biasing action of the spring. The fingers are rotated in a first direction along the long leg of the L-shaped slot to lock the washer in place to put the restraint device under a dynamic load to be discussed below. The threaded shaft 184 is rotated by end 208 which has a nut shape (see FIG. 10) to move the pad 180 into engagement with the outermost article. Continued rotation of the shaft moves the nut 188 out of the nest 190 against the biasing action of the springs 192 to put the restraint device 138 under a predetermined static load to be discussed below. During shipment, any transportation forces, e.g., oscillating or lateral forces imparted to the articles moving them away from the back wall are imparted to the spring 192 by way of the pads 178 and 180, shaft 184, and nut 188. The springs dampen the oscillatory and lateral forces, i.e., absorb shock, while urging the articles toward the back restraint member 96.

To release the mechanical front restraint device, the fingers 196 and 198 are rotated in a second direction along long legs of the slots 204 and 206, respectively, to release the biasing action of the spring 192. The shaft 184 is then rotated, e.g., as by hand, in a second direction to move the pads 178 and 180 away from the outermost article.

The rigid pad 178 and resilient pad 180 preferably have a surface area such that the force applied to the articles by the mechanical restraint device is distributed over a relatively large area of the articles to prevent concentration of the forces which could damage the articles. In general, it is recommended that the ratio of the surface area of the articles to be engaged by the pads 178 and 180 and the area of the pads 178 and 180 be between about 30–40. For example, for individual articles each having a surface area of 12 square feet (1.10 square meters) the area of the pads 144 and 146 should be about 0.4 square feet (0.0037 square meters).

As previously mentioned, the shaft is rotated to put the articles under a predetermined static load to unitize the articles as a pack. It has been found that for loads of 1 to 2 English tons(1.016 to 2.032 metric tons), the static load should be between about 120 inch pounds (670 centimeter kilograms) to 360 inch pounds (2010 centimeter kilograms) and preferably about 240 inch pounds (1340 centimeter kilograms). The dynamic load of the springs, i.e., the force applied when the washer 194 is locked in place should be sufficient to dampen the oscillatory and lateral forces. For example, for an article load of 1 to 2 English tons (1.016 to 2.032 metric tons) the dynamic load of the springs provides about 2,000 to 3,000 pounds (907.2 to 1360.8 kilograms) at 75 percent deflection of the spring. In other words, the spring has a remaining 25 percent deflection before the spring and has no dampening effect. A general rule to be employed for determining dynamic loads is 2,000 pounds (907.2 kilograms) at 75 percent deflection of the spring for each English ton of article weight.

As can be appreciated, most of the oscillatory forces act on the top edge 172 of the articles with the bottom edge 48 (see FIG. 3) held in place by the resilient pad 46. It is therefore recommended that the mechanical restraint device 138 engage the articles a distance from the top edge 172 equal to about ⅓the distance between the top edge and bottom edge of the articles.

The mechanical front restraint device 138 may be mounted at the ingress end 32 of the bin 20 in any conventional manner. For example, the mechanical front restraint device 138 may be mounted at the ingress end 32 in a similar manner as the pneumatic front restraint device was mounted at the ingress end. Another expedience that may be employed is illustrated in FIGS. 8, 9 and 10.

With reference to FIGS. 8, 9 and 10, the housing 186 is advantageously mounted on a rigid cross member 210. The cross member 210 is provided at opposed ends with headed studs 212 which are seated in the grooves 162 provided on the standards or posts 164 at the ingress end of the bin (shown in FIG. 8). To prevent the cross member 210 from moving out of the grooves 162 during transit, movable pins 214, biased to extend out of opposed ends of the member 210 into holes 216 on the posts 164 is provided. The pins 214 may be moved into the cross member by moving handles 218 together against biasing action of spring 220 (shown in FIG. 10).

As can be appreciated, the cross member 210 which maintains the mechanical restraint device, 138 at the ingress end of the bin (see FIG. 8) and the T-shaped member 156 which maintain the pneumatic restraint device 136 at the ingress end of the bin (see FIG. 1) should be of sufficient strength to absorb transportation forces without bending. Hollow, rectangular tubing having a ⅛–¼ inch (0.32–0.64 centimeters) wall thickness and a square cross-section having a 2–2 inch (5.08–6.45 centimeters) by 2–2½ inch (5.08–6.45 centimeters) outer dimensions have been found to be sufficient to withstand transportational forces which will be encountered during transit.

As can now be appreciated, the front restraint devices of the invention can be used when shipping more than one tier or more than one row of articles in a bin by providing a front restraint device for each tier or each row respectively.

DETAILED DESCRIPTION OF THE INVENTION

The invention will now be described for shipping automotive backlites 22 (see FIG. 2) made of ¼ inch (0.64 centimeters) thick tempered glass. The dimension of the bottom edge 48 is about 62 inches (158 centimeters) of the top edge 172 is about 66 inches (168 centimeters) and of the sides 52 is about 28 inches (71 centimeters).

With reference to FIG. 1, a bin 20 has a base 24 having dimensions of 75 inches (190 centimeters) by 36 inches (91 centimeters). Right sidewall 28 and 30 have dimensions of 36 inches (91 centimeters); by 44 inches (112 centimeters), respectively, and back wall 26 has dimensions of 75 inches (190 centimeters) by 44 inches (112 centimeters). Unless indicated otherwise, all rigid members are made of hollow tubing having a wall thickness of ⅛ inch (0.32 centimeters) square cross-section with dimensions of 2 inches (5.08 centimeters) by 2 inches (5.08 centimeters) securely mounted together as by welding.

The base 24 includes a pair of rigid longitudinal members 34 and 36 joined to ends of rigid lateral members 38, 40 and 42. A pair of stationary runners 44 are spaced about 25 inches (63.5 centimeters) apart about the lateral member 40 of the base 24. Rubber padding 46 is secured to the runners 44 in any conventional manner.

The end restraint disclosed in the above-mentioned U.S. Pat. application Ser. No. 488,346, now Pat. No. 3,961,709, filed even date will be used to prevent longitudinal motion of the backlites and to dampen longitudinal forces acting on the articles during transit. With reference to (FIG. 1) a pair of guide rails 74 made of tubing having a ⅛ inch (0.32 centimeters) wall thickness and a square cross-section having dimensions of 2 inches (5.08 centimeters) by 2 inches (5.08 centimeters) are provided on each side of the base 24. On the right side as viewed in FIG. 1, the guide rails 74 are secured at one end to lateral member 38 and at the other end to adjacent stationary runner 44. On the left side, the guide rails 74 are secured at one end to lateral member 42 and at the other end to adjacent stationary runner 44. The guide rails 74 are spaced about 24 inches (60.5 centimeters) apart about a center line between longitudinal members 34 and 36.

The guide rails 74 support a carriage 68 for moving end restraints 50 toward and away from the sides 52 of the backlites. The right and left carriage and end restraints 50 are identical in construction. Therefore, the carriage and end restraint on the left side of the bin as viewed in FIG. 1 will be discussed with the understanding that the discussion is applicable to the carriage and end restraint on the right side unless indicated otherwise.

With reference to FIGS. 4 and 5, the carriage 68 includes a sleeve 70 slideably mounted on each of the guide rails 74 and joined together by a rigid member 72. The sleeves are made of steel tubing having a wall thickness of 3/16 inch (0.48 centimeters) thick and a square cross-section having outer dimensions of 2½ inches (6.9 centimeters) by 2½ inches (6.9 centimeters). The sleeves are 8 inches (20 centimeters) in length. The rigid member 72 has a wall thickness of 3/16 inch (0.48 centimeters) and a square cross-section having dimensions of 2½ inches (6.9 centimeters) by 2½ inches (6.9 centimeters).

A steel upright 66 having a generally rectangular shape with a width of 4 inches (10.2 centimeters), a length of 6 inches (15 centimeters) and 3/8 inch (0.95 centimeters) thick has its width edge securely mounted to each of the sleeves 70. A generally L-shaped plate 60, ¼ inch (0.64 centimeters) thick has dimensions of approximately 28 inches (71 centimeters) in length, 8 inches (20 centimeters) in width for the long leg and approximately 1 inch (2.54 centimeters) by 28 inches (71 centimeters) for the short leg is provided with a pair of spaced plates 63, ⅜ inch (0.95 centimeters) thick. The spaced plates 63 are pivotally mounted to the uprights 66 at 64 as by pins so that the plate 60 fits the edge contour of the backlites (see FIG. 2). A rubber pad 62, ½ inch (1.27 centimeters) in thickness and having a durometer reading of 60 is provided on the plate 60 to prevent marring of the backlites.

A threaded shaft 76 having an outside diameter (O.D.) of 1 inch (2.54 centimeters) has an end 78 freely mounted in cross member 42 on the left side of the bin and a similar shaft 74 has an end 78 freely mounted in cross member 38 on the right side of the bin (see FIG. 1). The shaft 74 which is about 23 inches (58 centimeters) in length extends from the cross member 42 through a nut 80 securely mounted on the rigid member 72 and through the rigid member.

To prevent movement of the shaft 76 toward adjacent runner 44 and for rotating the shaft, a washer 82 and nut 84, respectively, are secured to the end 78 of the shaft as by welding. A nut 86 is secured to the shaft 74 at a point about 4 inches (10 centimeters) from the lateral member 42 to secure 28 disc springs made of chromium, vanadium steel having an O.D. of 2.200 inches (5.59 centimeters) and inside diameter (I.D.) of 1.22 inches (3.10 centimeters) and a thickness of 0.591 inches (1.5 centimeters) on the shaft between the nut 86 and the cross member 42. The springs are of the type sold by E. C. Styberg Engineering Co., Inc., and arranged such that each pair of springs has a concave face opposite each other to provide a bellow type spring as shown in FIGS. 4 and 5.

With this arrangement, the end restraint has a force of about 17,000 pounds (7,711 kilograms) at 75 percent deflection of the springs to dampen longitudinal forces of the backlites as the backlites move along the longitudinal reciprocating path while maintaining the end restraint in engagement with the sides 52 of the backlites 22.

One of the end restraints, e.g. the right and restraint as viewed in FIG. 1 is moved toward its adjacent runner 44 by rotating the nut 84 in a first direction. The right end restraint is positioned about 31 inches (78.7 centimeters) from the center lateral member 40 to seat automotive windshields to be subsequently loaded. The left end restraint is moved away from the adjacent runner 44 by rotating the nut 84 is a second direction.

The back wall 26 of the bin 20 is provided with a back restraint member 96 (1) to give the articles packing stability and (2) to absorb oscillatory and lateral forces as the backlites move toward the back wall of the bin during transit. The back restraint 96 is of the type disclosed in the previously mentioned U.S. Pat. application Ser. No. 488,347, now U.S. Pat. No. 3,964,608 filed even date.

With reference to FIGS. 1, 3 and 6, the back restraint member 96 includes a steel plate 103, ¼ inch (0.64 centimeters thick, 4 inches (10.2 centimeters) wide and 36 inches (91.8 centimeters) in length. A ½ inch (1.3 centimeters) thick rubber pad 104 with a durometer reading of 60 is advantageously bonded to a side of the plate 103. The opposite side of the plate 103 is secured to a U-shaped member 102. The U-shaped member is ¼ inch (0.64 centimeters) thick having legs 98 with dimensions of 1½ inch (3.81 centimeters) by 36 inches (91 centimeters) and a center leg 100 with dimensions of 1½ inches (3.81 centimeters) by 36 inches (91.8 centimeters) to provide a spacing between legs of about 1 inch (2.54 centimeters). A plurality of holes 126, ½ inch (1.3 centimeters) in diameter on a center to center spacing about 1½ inch (3.81 centimeters) is provided on each of the legs 98 for pivotally mounting one end of a top strut 106 and one end of a bottom strut 108 by way of pins 114 to the U-shaped member 102.

The struts 106 and 108 are each 8 inches (20 centimeters) in length and made of tubing having a wall thickness of ⅛ inch (0.32 centimeters) square cross-section 1 inch by 1 inch (2.54 centimeters by 2.54 centimeters). The opposite end of each of the struts 106 and 108 is pivotally mounted to a generally U-shaped channel 120 of the back wall 26 by way of pins 122. The U-shaped channel 120 has a wall thickness of ¼ inch (0.64 centimeters) and a spacing between the legs of 1 inch (2.54 centimeters). The U-shaped channel 120 is provided with a plurality of holes 126, 1/2 inch (1.3 centimeters) in diameter on a center to center spacing of 1½ inches (3.8 centimeters) to provide adjustments to the back support member 96.

The back support member 96 is arranged to provide a 5° angle of tilt from a line normal to the base 24 of the bin 20 to provide for packing stability and cancel out swaying motions of the articles. The U-shaped member 102, U-shaped channel 120 and the top and bottom struts 106 and 108 are arranged to provide a frustrum of a triangle configuration which gives ridigity to the back support member 96. (see FIG. 3). More particularly, the distance between ends 110 and 112 of the struts 106 and 108, respectively, is 10 inches (25.4 centimeters) and the distance between ends 116 and 118 of the struts 106 and 108, respectively, is 18 inches (45.7 centimeters). Further, the bottom end of the plate 103 as viewed in FIG. 1 rests on center lateral member 40 for further stability.

The bin is now ready for receiving the automotive backlites 22. Approximately 80 backlites are loaded in the bin on an edge 48 and separated by dimpled paper 222 to prevent surface marring of adjacent surfaces (see FIG. 3). After the backlites are loaded, the shaft 76 of the left end restraint member 50 is rotated in a second direction to move the end restraint into contact with the sides 52 of the backlites (see FIG. 2).

The backlites 22 may be secured in the bin with a pneumatic restraint device 136 (see FIGS. 1, 2, 3 and 7) or by a mechanical restraint device 138 (see FIGS. 8, 9 and 10) each incorporating features of the invention.

With reference to FIGS. 1, 2, 3 and 7, the backlites will be secured in the bin 20 using the pneumatic restraint device 136. The pneumatic restraint device 136 includes an inflatable member 140 having a rigid pad 144 on one side and a rigid pad 142 on the other side. The pads 142 and 144 are each 6 inches (15 centimeters) in diameter and ¼ inch (0.64 centimeters) thick. A valve 148 is provided on the plate 142 for inflating and deflating the member 140. Such an inflatable member may be purchased from Firestone Co. and are known as airmounts.

A rubber pad 146, ½ inch (1.27 centimeters) thick having a durometer reading of 60 is secured to the pad 144 in any conventional manner. A pair of headed studs 150 are provided on the pad 142. A generally, T-shaped member 156 having outer arms 158 and a leg 154 made of ⅛ inch (0.32 centimeters) thick steel tubing having a square cross-section with outer dimension of 2 inches (5.08 centimeters) by 2 inches (5.08 centimeters) is provided to securely mount the pneumatic restraint device at the ingress end 32 of the bin 20.

The leg 154 of the T-shaped member 156 is 36 inches (91 centimeters) in length and is provided on one side with a groove 152 having a width less than the head of the studs 150 to slideably mount the pneumatic device on the leg 54.

The T-shaped member 156 having the pneumatic restraint device 136 is mounted at the ingress end 32 of the bin by providing headed studs 160 at the ends of the outer legs 158 and a stud 166 at the free end of the leg 154. The headed studs 160 are seated in grooves 162 provided in posts 164 at the ingress end of the bin (see FIG. 2) and the stud 166 is mounted in the hole of a plate 170 mounted to the longitudinal member 36 (see FIG. 3). The plate 170 is approximately 2 inches (5.08 centimeters) by 4 inches (10.2 centimeters) and ¼ inch (0.64 centimeters) thick.

The pneumatic restraint device 136 is moved along the groove 152 until the center of resilient pad 146 is about 10 inches (25.4 centimeters) from the top edge 172 of the article. Air is moved into the valve to inflate the member 140 to move the pad 146 into engagement with the stack. The inflatable member is inflated to a pressure of about 40 psi. This applies a static force of about 1,200 pounds (544.32 kilograms) to unitize the articles. In other words, the article responds to transportation forces as a single unit.

During transit, longitudinal forces acting on the backlites are absorbed by the end restraints 50. The backlites are accelerated toward one end of the restraints, e.g, the right end restraint as viewed in FIG. 2. Referring to FIGS. 4 and 5, when the longitudinal force acting on the backlites overcomes the biasing action of the spring 88, the end restraint moves along the guide rails 74 moving the shaft 76 and nut 86 against the biasing action of the of the disc springs 88. The springs 88 are urged against the cross member 42 of the sidewall 30 and are compressed which increases the biasing action of the spring. When the biasing action of the spring is greater than the longitudinal force, the springs 88 bias the nut 86 and shaft 76 toward the sides of the backlites moving the backlites back along the longitudinal path against the other end restraint, e.g., the left end restraint, as viewed in FIG. 2. The left end restraint dampens the longitudinal force in a similar manner as the right end restraint and urges the backlites toward the right end restraint. In this manner, the longitudinal forces are dampened to prevent damage to the edges 52 of the backlites 22 (see FIG. 2) and to maintain the end restraints in engagement with the sides of the backlites.

Also during shipment, oscillatory forces pivot the backlites about the bottom edge 48 and lateral forces move the backlites away from the back restraint member 96 against the pneumatic restraint device 136. The pneumatic restraint device 136 absorbs any oscillatory forces and lateral forces while urging the backlites toward the back restraint member 96. More particularly, as the backlites respond to the oscillating and/or lateral forces, the backlites 22 move away from the back restraint member 96 against the pneumatic front restraint device 136. The pneumatic front restraint device dampens the oscillating and lateral forces while urging the articles against the back restraint device. The resilient pad 104 of the back restraint member 96 absorbs the forces urging the articles toward the front restraint device.

To unload the bin, the valve 148 is operated to deflate the member 140 which moves the rigid pad 144 and resilient pad 146 away from the article. The T-shaped member 156 is removed from the ingress and 32 of the bin.

With reference to FIGS. 8, 9 and 10, the discussion will now be directed to using the mechanical restraint device 138 to secure the backlites 22 in the bin as a unitized pack and to dampen oscillatory and lateral forces acting on the articles to move them along the paths. The mechanical restraint device 138 includes a steel member 178, 6 inches (15 centimeters) in diameter and ⅛ inch (0.32 centimeters) thick having a rubber pad 180, ½ inch (1.3 centimeters) thick with a durometer reading of 60 adhesively bonded thereto. Pivotally mounted on the other end of the member 178 at 182 is one end of a threaded shaft 184, ¼ inch (0.64 centimeters) thick and 6 inches (15 centimeters) long.

The other end of the shaft passes into housing 186 and has a nut 188 secured thereto.

The housing 186 is made of steel tubing ⅛ inch (0.32 centimeters) thick and has a 2½ inch (6.9 centimeters) cubic shape. The nut 188 is seated in a nest ¾ inch (1.9 centimeters) deep to prevent rotation of the nut when the nut end 208 of the shaft 184 is rotated to move the member 178 and pad 180 toward and away from the backlites. Mounted in the housing 186 on the shaft 184 are 4 chromium, vanadium, steel spring discs having O.D. of 2.20 inches (5.59 centimeters), an I.D. of 1.122 inches (3.10 centimeters) and 0.591 inches (1.5 centimeters) thick arranged to provide a bellow spring as viewed in FIG. 9. Each spring provides 600 pounds (152.16 kilograms) force at 75 percent deflection.

A washer 194 having the O.D. of 2.20 inches (5.59 centimeters) and an I.D. of 1.122 inches (3.10 centimeters) and a thickness of ⅜ inch (0.95 centimeters) is mounted in the housing. The washer 194 is provided at its periphery with a pair of fingers 196 and 198 which extend through grooves 204 and 206 on sides 200 and 202, respectively, of the housing 186. The fingers are ¼ inch (0.64 centimeters) in diameter. The groove 204 and the side 200 has an inverted L-shape and the groove 206 on the side 202 has an upright L-shape. The groove is about 5/16 inch (0.75 centimeters) wide with the short leg 1 inch (2.54 centimeters) long and the long leg 1½ inches (3.81 centimeters) long.

The mechanical restraint device 138 is maintained at the ingress end of the bin by a cross member 210 made of steel tubing 3/16 inch (0.45 centimeters) thick and having a square cross-section and dimensions of 2½ inches by 2½ inches (6.35 centimeters by 6.35 centimeters). Provided at each end are headed studs 212 which are seated in the grooves 162 on the standards or posts 164. To prevent the cross member 210 from moving out of the grooves during shipment, the cross member is provided at the ends with spring biased pins 214 which are moved into the end of the cross member by operating handles 218 against the biasing action of the spring 220 (see FIG. 10). When the handles are released, the spring biased pins are urged out of each end of the member 210 and are seated in holes 216 on the posts 164.

The cross member 210 is mounted at the ingress end 32 of the bin such that the center of the pad 180 is spaced about 10 inches (25.40 centimeters) from the top edge 172 of the backlite 22.

The fingers 196 and 198 are moved forward along the short leg of the grooves 204 and 206, respectively, to put the springs in compression and then rotated in the first direction to move the fingers 196 and 198 in the long leg of the grooves 204, 206, respectively, to lock the restraining the device 138 in position. The springs exert a force of 2,400 pounds (1088.64 kilograms) at 75 percent deflection which is sufficient to dampen oscillatory forces and lateral forces during transit. The nut shaped end 208 of shaft 184 is rotated to move the disc 178 and pad 180 against the backlites with a static load to about 240 inch pounds (1340 centimeter kilograms).

During transit, oscillatory forces pivot the backlite about edge 48 and lateral forces move the backlite away from the back restraint member 96 against the biasing action of the springs. When the oscillatory and/or lateral forces overcome the biasing action of the spring 192, the member 178 is urged away from the back wall to move the shaft 184 into the housing 186. The shaft moves the nut 188 out of the nest against the biasing action of the springs 192. When the force of the spring is greater than the oscillatory and/or lateral forces, the spring operates on the nut 188 to move the shaft out of the housing urging te backlites against the back restraint member 96. The backlites engage the resilient pad 104 of the back restraint member 96 which absorbs the force of the backlites urging it toward the pneumatic front restraint device.

To unload the bin the fingers 196 and 198 are moved along the long leg of the slots 204 and 206, respectively, and then away from the backlites along the short leg to release the force of the spring acting on the nut. The shaft 184 is rotated as by hand in a second direction to move the disc 178 and pad 180 away from the backlites. Thereafter, the cross member 210 is removed from the ingress end of the bin.

What is claimed is:

1. A mechanical restraint device for dampening oscillatory and lateral forces acting on a plurality of automotive backlites during shipment, wherein the articles are supported on a first edge and tilted toward a back support member and wherein the oscillatory forces move the backlites about the first edge toward and away from the support member along a first movement path and the lateral forces move the backlites away from the support member along a second movement path comprising:

- a rigid member having a first major surface opposite to a second major surface;
- a resilient pad mounted on the first major surface of said member;
- a threaded shaft having one end pivotally mounted to the second major surface of said rigid member;
- a housing for receiving the second end of said threaded shaft and having a groove in at least one pair of opposed surfaces;
- a nut mounted on the second end of said shaft to detachably secure said shaft in said housing;
- a nest mounted in said housing for receiving said nut and for preventing rotation of said nut;
- a plurality of disc springs mounted on said shaft in said housing;
- a washer mounted in said housing against biasing action of said disc springs to urge said disc springs against said nut in said nest;
- means for mounting said housing in the first and second movement path such that said resilient pad engages the backlites; and
- a finger member passing through each of the grooves of said housing and securably mounted to said washer for maintaining said springs in compression against said nut wherein rotating said shaft out of the housing moves said pad against the outermost backlite against biasing action of said springs to urge the backlites together against the back support member and urging said finger members toward the backlites along the grooves moves said washer against said springs to increase the biasing action of said springs on said shaft by way of said nut such that the backlites respond to the oscillatory and lateral forces as a unitized pack and to dampen oscillatory forces and lateral forces acting on the articles during shipment.

2. In a bin for shipping loose sheets, wherein the bin is of the type having a back support secured to a base for supporting each of the sheets on an edge in a generally vertical position in facing relationship to one another, the improvement comprising:

a rigid member having an engaging surface and a major surface opposite to the engaging surface;

a spring biased shaft having one end mounted to the major surface of said rigid member;

means mounting said shaft for securing said shaft in spaced relation to the back support and the base with the engaging surface of said member facing the back support; and means acting on said shaft for moving the engaging surface of said member toward the back support wherein the engaging surface engages outermost one of the plurality of sheets to be shipped, said spring biased shaft urging said rigid member against the outermost sheet to urge the sheets together against the back support such that the sheets during shipment respond to oscillatory and lateral forces as a unitized pack and said shaft dampens oscillatory and lateral forces acting on the sheets during shipment.

3. The bin as set forth in claim 2 wherein the sheets are glass sheets.

4. The bin as set forth in claim 2 wherein said securing means includes means for positioning said member at different positions in spaced relation to the base.

5. The bin as set forth in claim 2 further including end restraints for limiting lateral motion and dampening lateral forces of the sheets during shipment.

6. The bin as set forth in claim 2 wherein said moving means further includes:

a housing for receiving the other end of said shaft;

means for detachably securing the other end of said shaft in said housing; and spring means acting on said detachably securing means and mounted in said housing for biasing said shaft and said rigid member to ruge the articles together against the support member and for absorbing oscillatory and lateral forces of the articles during shipment to dampen oscillatory and lateral forces acting on the article.

7. The bin as set forth in claim 6 wherein said spring biased shaft includes:

a plurality of concave disc springs mounted on the end of the shaft in said housing and acting on said detachably securing means;

a washer mounted in said housing and acting on said disc springs; and finger members mounted on said washer and extending out said housing wherein moving said finger members toward said articles puts the disc springs under compression and rotating said finger members secures the disc springs in position.

8. The bin as set forth in claim 2 wherein the end restraints comprise: 'at least one guide rail means mounted on the base generally parallel to the back wall;

carriage means mounted on said guide rail means for movement in a first direction toward the center of the base and in a second direction opposite to the first direction;

a rigid plate mounted on said carriage means;

means acting on said carriage means for moving said carriage in the first direction to a selected one of a plurality of positions and for moving said carriage in the second direction; and means for dampening forces acting on said plate to move said carriage means in the second direction from the selected one of the plurality of positions.

9. The end restraint as set forth in claim 8 wherein said moving means includes:

a threaded shaft having one end rotatably mounted and the other end threaded to said carriage means wherein rotating said threaded shaft in a first direction moves said carriage means in the first direction and rotating said threaded shaft in a second direction moves said carriage in the second direction; and said dampening means includes:

a shaft having one end mounted to said carriage means and the other end mounted for reciprocal movement; and biasing means mounted on said shaft, said biasing means being compressed when said carriage moves in the second direction to dampen the forces acting to move the carriage in the second direction.

10. The bin as set forth in claim 2 wherein the back support comprises:

a rigid member;

means for maintaining said rigid member and the back wall in spaced relation;

means for maintaining said maintaining means to the back wall and said rigid member; and means for providing stability to said rigid member.

11. The adjutable back support as set forth in claim 10 wherein said maintaining means and mounting means comprises:

a first strut having a first end and a second end;

a second strut having a first end and a second end; and means for pivotally mount (1) the first ends of said first and second struts at a predetermined distance and (2) the second ends of said first and second struts at a second predetermined distance.

12. An article shipping bin of the type having a base, sidewalls and a back wall arranged in a generally parallelepiped configuration, comprising:

a first pair of rigid members having one end secured to the first lateral member and extending toward the center of the base in generally parallel relationship to the back wall;

a second pair of rigid members having one end secured to the second lateral member and extending toward the center of the base in generally parallel relationship to the back wall;

means mounted to the other end of said first and second pairs of rigid members for maintaining said first and second pairs of rigid members on the base;

a sleeve slideably mounted on each of the rigid members of said first and second pair of rigid members;

a first rigid cross member interconnected to said sleeves mounted on said first pair of rigid members to form a first carriage;

a first plate mounted to the first carriage;

a second rigid cross member interconnected to said sleeves mounted on said second pair of rigid members to form a second carriage;

a second plate mounted to the second carriage;

a first threaded shaft having one end threaded to said first rigid cross member and the second end mounted in the first lateral member for rotational and reciprocal longitudinal movement wherein rotating said first shaft in a first direction moves the carriage away from the first lateral member and rotating said shaft in a second direction moves the carriage toward the first lateral member;

a second threaded shaft having one end threaded to said first rigid cross member and the second end mounted in the second lateral member for rotational and reciprocal longitudinal movement wherein rotating said second shaft in a first direction moves the carriage away from the second lateral member and rotating said second shaft in a second direction moves the carriage toward the second lateral member;

a first spring means mounted on said first shaft between said first lateral member and said first carriage wherein forces applied to said first plate by the articles compresses said first spring means to dampen the forces applied to said first plate and to urge said carriage and plate away from the first lateral member;

a second spring means mounted on said second shaft between the second lateral member and said second carriage wherein forces applied to said second plate by the articles compresses said second spring means to dampen the forces applied to said second plate and to urge said carriage and plate away from the second lateral member;

a rigid support member;

a first strut having a first end and a second end;

a second strut having a first end and a second end;

means for pivotally mounting (1) the first ends of said first and second struts to said rigid support member at a first predetermined distance and (2) the second ends of said first and second struts to the back wall at a second predetermined distance greater than the first predetermined distance;

a rigid member having a first major surface opposite to a second major surface;

a resilient pad mounted on the first major surface of said member;

a threaded shaft having one end pivotally mounted to the second major surface of said rigid member;

a housing for receiving the second end of said threaded shaft and having an upright "L-shaped" groove on a first surface and an inverted "L-shaped" groove on a second surface opposite to the first surface;

a nut mounted to the second end of said shaft to detachably secure said shaft in said housing;

a nest mount in said housing for receiving said nut and for preventing rotation of said nut when said shaft is rotated;

a plurality of disc springs mounted on the second end of said shaft in said housing;

a washer mounted in said housing and acting on said disc springs to urge said disc springs against said nut;

means for mounting said housing in spaced relation to said back support such that said resilient pad faces the articles; and a finger member passing through each of the grooves of said housing and securely mounted to said washer for maintaining said springs in compression against said nut wherein rotating said shaft out of the housing moves said pad against the articles against biasing action of said springs to urge the backlites together against said back support and urging said finger members toward the articles along the grooves moves said washer against said springs to increase the biasing action of said springs on shaft by way of said nut such that the articles respond to the oscillatory and lateral forces as a unitized pack and to dampen oscillatory and lateral forces of the backlites during shipment.

13. The bin as set forth in claim 12 wherein the articles are automotive backlites.

* * * * *